US006113356A

United States Patent [19]

Eller et al.

[11] Patent Number: 6,113,356

[45] Date of Patent: Sep. 5, 2000

[54] HYDRAULICALLY LIFTABLE MOBILE PUMPING APPARATUS

[76] Inventors: J. David Eller; Dana J. Eller; Daren J. Eller, all of 201 N. Federal Hwy., Deerfield Beach, Fla. 33441-2013

[21] Appl. No.: 09/236,426

[22] Filed: Jan. 25, 1999

[51] Int. Cl.[7] ..... F04B 53/00

[52] U.S. Cl. ..... 417/234; 92/110; 92/117 R; 280/763.1; 280/764.1; 212/301; 212/302; 212/304

[58] Field of Search ..... 417/234; 92/110, 92/117 R; 280/43.14, 43.24, 763.1, 764.1; 212/301, 302, 304

[56] References Cited

U.S. PATENT DOCUMENTS

| | | | |
|---|---|---|---|
| 4,050,858 | 9/1977 | Ewbank et al. | 417/234 |
| 4,070,135 | 1/1978 | Marlin | 417/234 |
| 4,124,226 | 11/1978 | Phillips | 280/765.1 |
| 4,170,264 | 10/1979 | Gibson | 169/24 |
| 4,238,036 | 12/1980 | Lamer et al. | 212/166 |
| 4,364,228 | 12/1982 | Eller | 60/398 |
| 4,616,979 | 10/1986 | Hynes et al. | 417/231 |
| 4,632,262 | 12/1986 | Olsen et al. | 212/304 |

*Primary Examiner*—Mark Paschall
*Assistant Examiner*—Jeffrey Pwu
*Attorney, Agent, or Firm*—Oltman, Flynn & Kubler

[57] ABSTRACT

A placement and orienting apparatus for a pump and water passing pipe assembly includes a wheeled trailer supporting the pump and water passing pipe assembly; an upper frame structure; a lower frame structure; a turntable bearing assembly positioned between and interconnecting the upper and lower frame assemblies and permitting rotation of the upper frame structure relative to the lower frame structure; a motor drivably connected to one of the upper frame structure, the lower frame structure and the turntable bearing assembly to rotate the upper frame structure and the trailer relative to the lower frame structure and the ground; and at least one upright hydraulic cylinder having a cylinder lower end connected to the upper frame structure and having a cylinder upper end connected to the trailer to drive the upper and lower frame assemblies downwardly together from the trailer so that the lower frame structure makes contact with the ground and elevates the trailer from the ground.

5 Claims, 4 Drawing Sheets

HYDRAULICALLY LIFTABLE MOBILE PUMPING APPARATUS

BACKGROUND OF THE INVENTION

1. Field of the Invention

The present invention relates generally to the field of pump assemblies for large scale water delivery such as for irrigation and for flood control. More specifically the present invention relates to a placement and orientation apparatus for a pump and water passing pipe assembly such as an internal combustion engine powered irrigation pump.

The apparatus includes a trailer for delivering the pump and water passing pipe assembly to a job site, and a trailer orientating mechanism for rotating the trailer and water passing pipe into position. The trailer orienting mechanism includes a generally horizontal lower frame structure connected to a generally horizontal upper frame structure by a turntable bearing assembly which permits rotation of the upper frame structure relative to the lower frame structure. Four vertically positioned hydraulic cylinders have cylinder lower ends which are connected at equally spaced apart points to the upper frame structure and have cylinder upper ends which are connected to the trailer. Upon disconnection of the trailer from the tractor, hydraulic activation of the cylinders drives the upper and lower frame structures downwardly together from the trailer so that the lower frame structure makes contact with the ground and elevates the trailer.

A hydraulic motor rotates the upper frame structure relative to the lower frame structure, rotating the trailer relative to the ground. In this way, operation of the hydraulic motor orients the trailer and thus the water passing pipe as needed to perform a given pumping task.

2. Description of the Prior Art

There have long been large pumps coupled to water gathering pipes for large scale water delivery jobs such as field irrigation. What has been absent is a device for placing and orienting the heavy pumps and pipes for use, and for subsequent removal when the job is completed.

It is thus an object of the present invention to provide a pump and water passing pipe assembly placement and orientation apparatus which provides rapid and effortless placement and positioning of a heavy pump and pipe assembly at a job site and at an orientation for use.

It is another object of the present invention to provide such an apparatus which is suitable for placing and orienting a wide variety of pumps and pipes for numerous applications.

It is still another object of the present invention to provide such an apparatus which is reliable and relatively simple in design.

It is finally an object of the present invention to provide such an apparatus which is inexpensive to manufacture.

SUMMARY OF THE INVENTION

The present invention accomplishes the above-stated objectives, as well as others, as may be determined by a fair reading and interpretation of the entire specification.

A placement and orienting apparatus is provided for a pump and water passing pipe assembly including a wheeled trailer supporting the pump and water passing pipe assembly; an upper frame structure; a lower frame structure; a turntable bearing assembly positioned between and interconnecting the upper and lower frame assemblies and permitting rotation of the upper frame structure relative to the lower frame structure; a motor drivably connected to one of the upper frame structure, the lower frame structure and the turntable bearing assembly to rotate the upper frame structure and the trailer relative to the lower frame structure and the ground; and at least one upright hydraulic cylinder having a cylinder lower end connected to the upper frame structure and having a cylinder upper end connected to the trailer to drive the upper and lower frame assemblies downwardly together from the trailer so that the lower frame structure makes contact with the ground and elevates the trailer from the ground.

The turntable bearing assembly preferably includes an outer raceway; and a ring-shaped inner raceway mounted underneath the outer raceway and including a channel containing several ball bearings and having an interior circumference lined with gear teeth; where the motor includes a gear box having an output gear in drivable contact with the inner raceway interior circumference. The upper frame structure preferably includes two structural cross-members intersecting and joined at their midpoints, where the turntable outer raceway is fastened to the underside of the upper frame structure; and a motor mounting port in the outer raceway containing the hydraulic motor. The lower frame structure preferably includes several interconnected structural members, where the turntable inner raceway is mounted to the upper surfaces of the lower frame structure and is oriented so that the channel opens upwardly; so that the upper frame structure is placed on top of the lower frame structure and the weight of the upper frame structure and of the trailer, pump and pipe are borne by the turntable bearing assembly.

The at least one hydraulic cylinder is preferably a ported-piston rod cylinder, so that the piston rod remains stationary relative to the trailer while the cylinder moves upwardly and downwardly relative to the trailer during lowering and lifting of the trailer.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
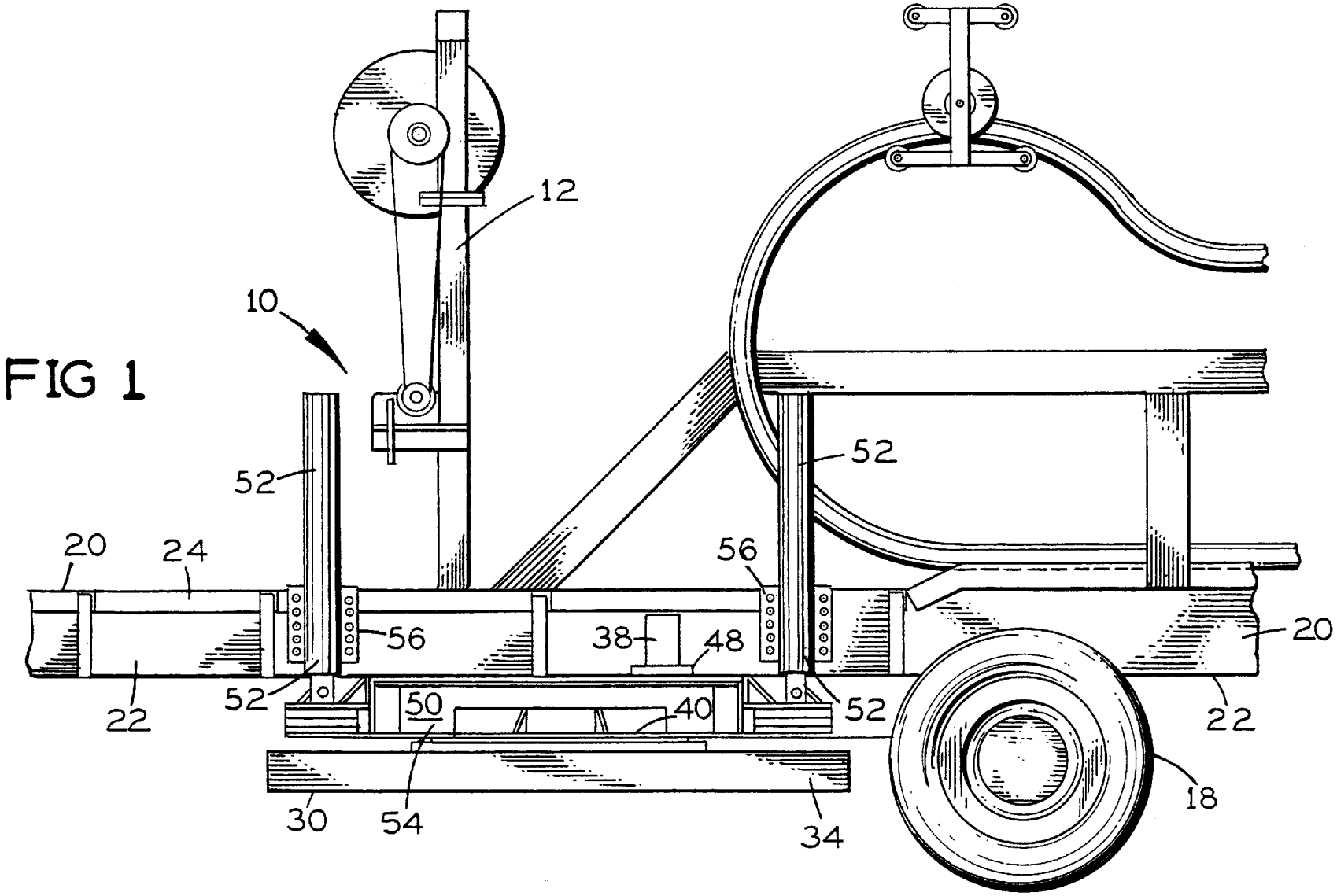
FIG. 1 is a cross-sectional side view of the placing and orienting apparatus for a pump and water delivery pipe delivery assembly, showing part of the assembly and a segment of the trailer.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
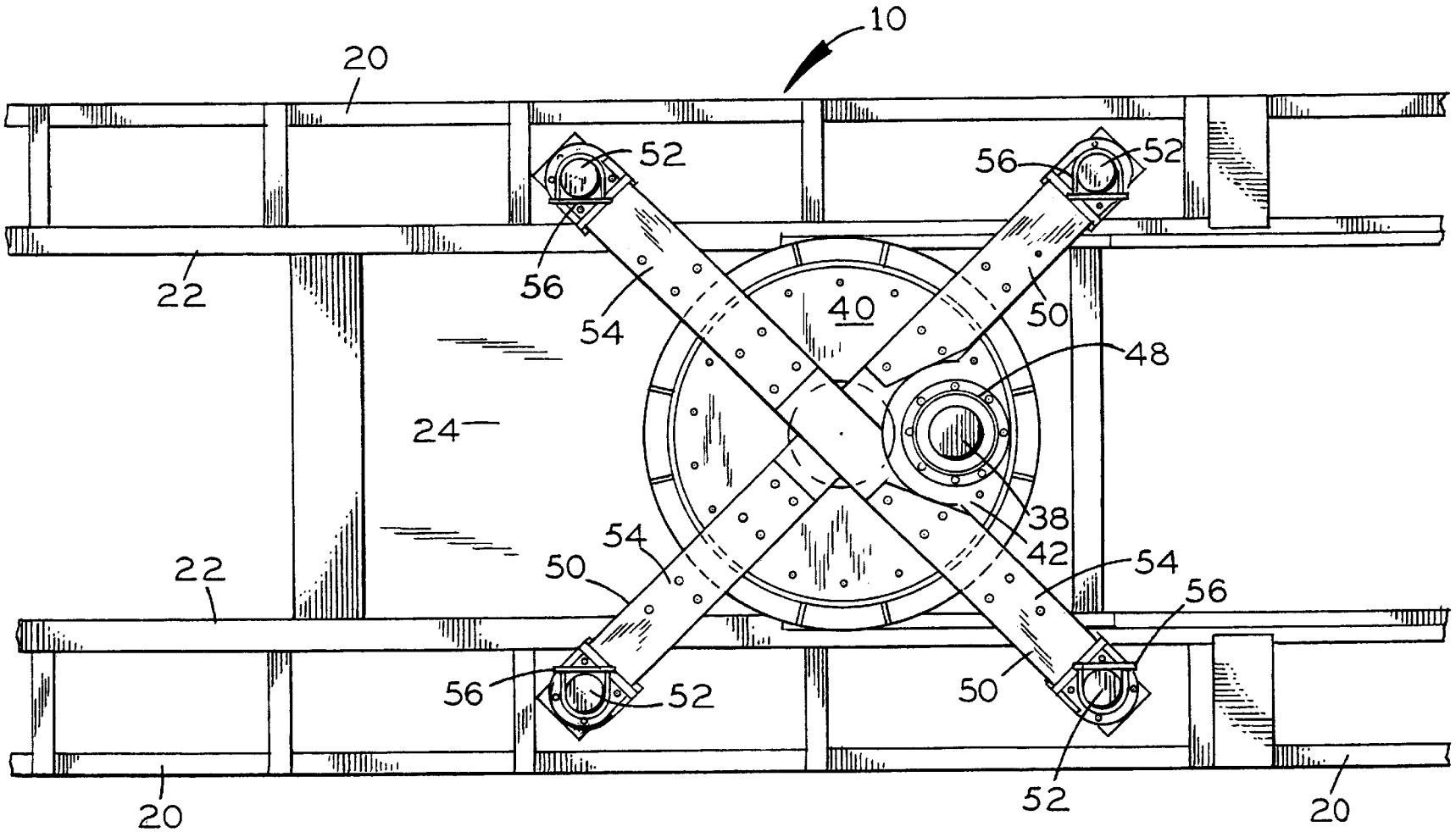
FIG. 2 is a top cross-sectional view as in FIG. 1, omitting the pump and water delivery pipe delivery assembly.
Figure 3:
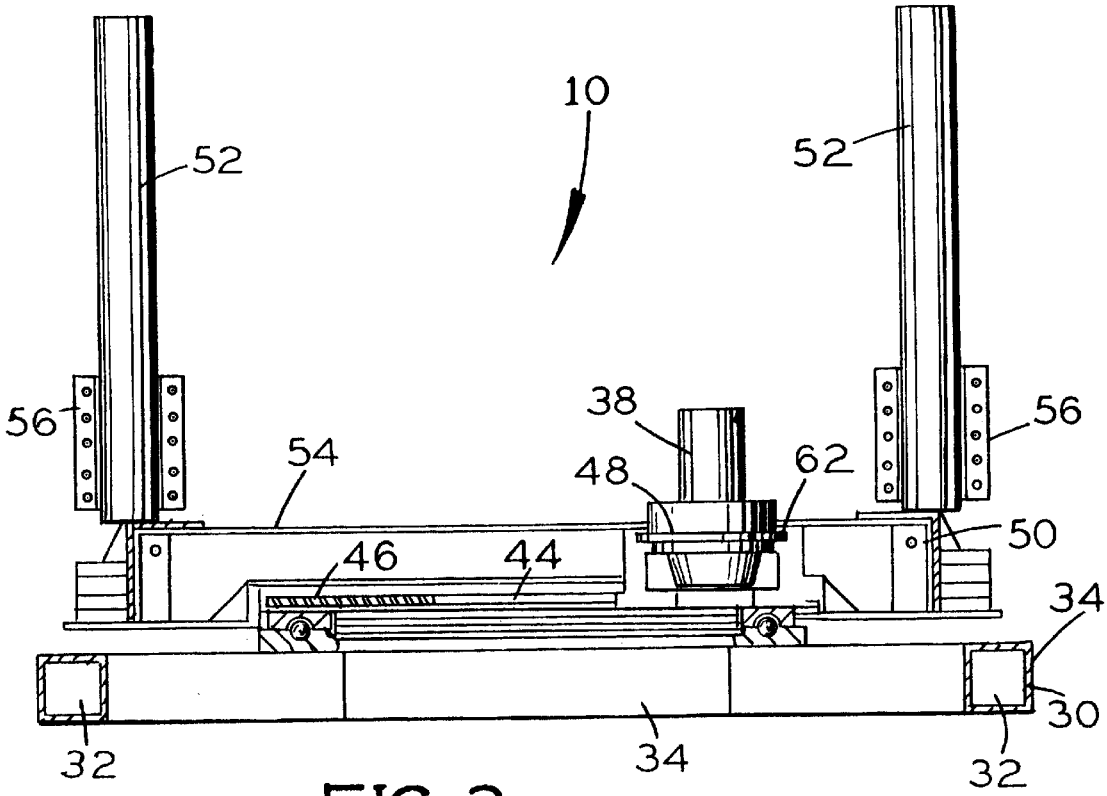
FIG. 3 is a sectional side view of the orienting mechanism of the apparatus, showing the upper and lower frame structures in their elevated position.
Figure 4:
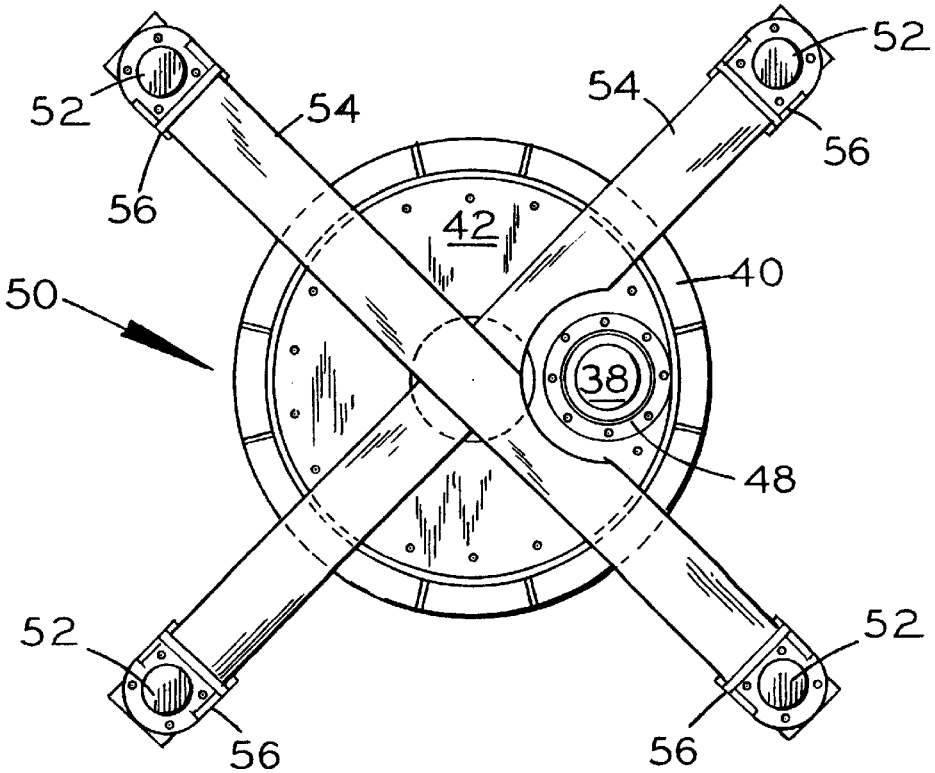
FIG. 4 is a top view of the upper frame structure and the attached turntable outer raceway, showing the motor and motor port.
Figure 5:
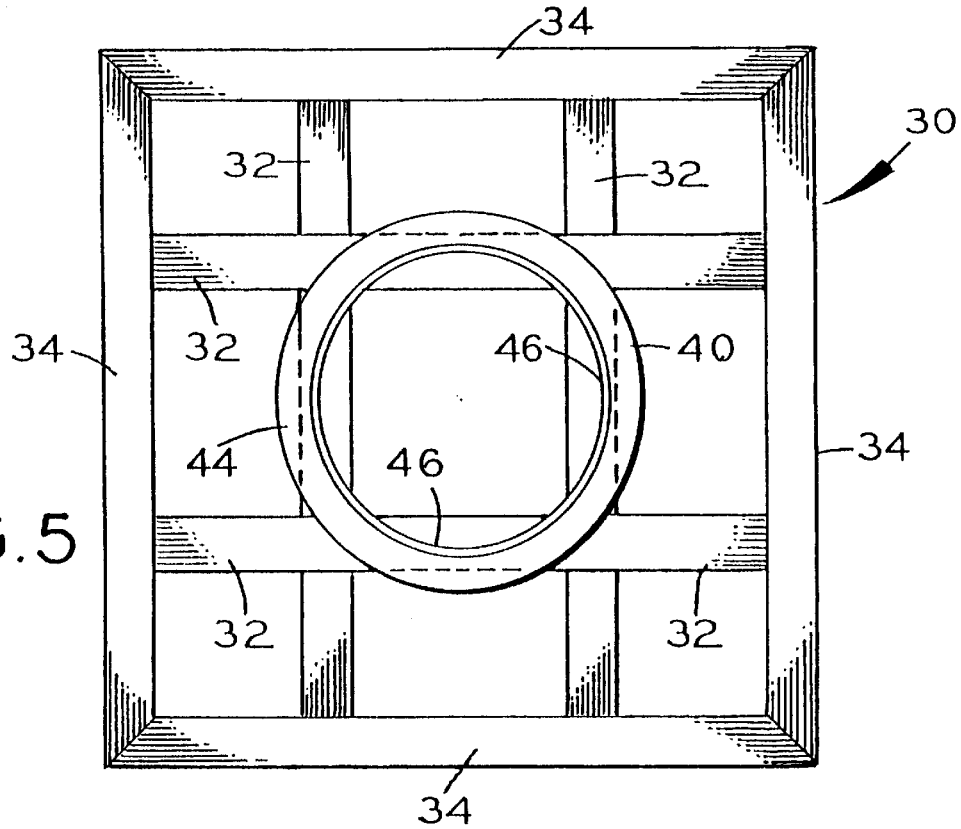
FIG. 5 is a top view of the lower frame structure and the attached turntable inner raceway, showing the interior circumference which is lined with gear teeth.
Figure 6:
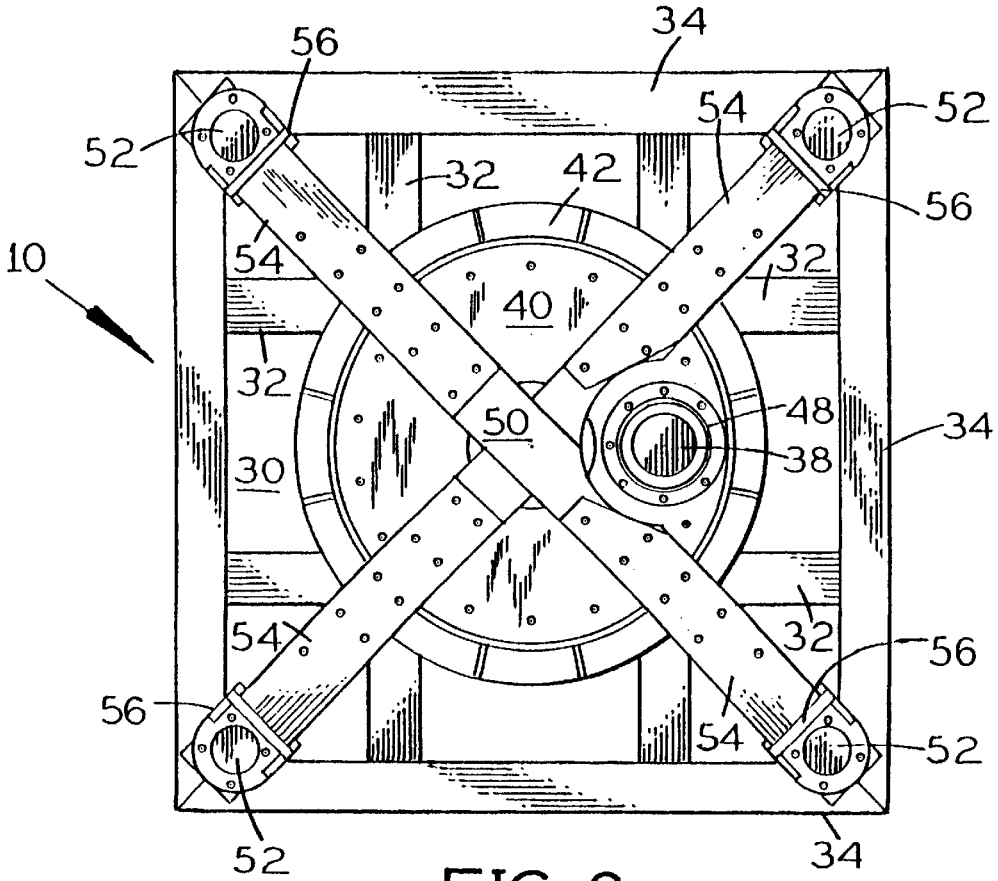
FIG. 6 is a top view of the upper and lower frame structures coupled together about the turntable bearing assembly.

Referring to FIGS. 1–6, an orienting apparatus 10 is disclosed for a pump and water passing pipe assembly 12 such as an internal combustion engine powered irrigation pump assembly. Pump and water passing pipe assembly 12 itself is prior art and preferably includes the trailer 20 of a conventional tractor-trailer in which the trailer 20 is an enclosed structure having a conventional tractor hitch (not shown) at its forward end and six opposing dual sets of conventional trailer support wheels and tires 18 along its rearward end. Trailer support beams 22 extend longitudinally along the trailer floor 24. The water passing pipe (not shown) includes a water passing pipe intake segment and a water passing pipe discharge segment, both passing longitudinally within trailer 20. A pump (not shown) is positioned between and interconnects the pipe intake and discharge segments and a diesel engine (not shown) within trailer 20 is drivably connected to the pump. Details of the preferred pump and water passing pipe assembly 12 may be found in U.S. Pat. Nos. 4,364,228 and 4,797,067 issued to the present applicant.

Orienting apparatus 10 preferably includes a generally horizontal lower frame structure 30 connected to a generally horizontal upper frame structure 50 by a turntable bearing assembly 40 which permits rotation of upper frame structure 50 relative to lower frame structure 30. Four vertically positioned hydraulic cylinders 52 have cylinder lower ends which are connected at equally spaced apart points to upper frame structure 50 and have cylinder 52 upper ends which are laterally connected with brackets 56 to the trailer support beams 22. See FIGS. 1–3. Upon disconnection of the trailer 20 from the tractor, hydraulic activation of the cylinders 52 drives the upper and lower frame assemblies 50 and 30, respectively, downwardly together from the trailer floor 24 so that lower frame structure 30 makes contact with the ground and thereby elevates the trailer 20 so that the trailer wheels rise off the ground.

Turntable bearing assembly 40 preferably includes a disk-shaped outer raceway 42 on top and a ring-shaped inner raceway 44 beneath the outer raceway 42. Near the periphery of the inner raceway 44 is a channel (not shown) within which a series of ball bearings (not shown) ride. The interior circumference of the inner raceway 44 is cut to form a continuous series of turntable gear teeth 46. This type of turntable bearing assembly 40 is often used in crane design. The preferred turntable bearing make is Avon and the model is 737 HBI.

Upper frame structure 50 preferably includes two structural cross-members 54 integrally joined at their midpoints. See FIG. 4. The turntable gear outer raceway 42 is fastened to the underside of these intersecting cross-members 54, so that the ball bearing engaging portion of outer raceway 42 is directed downwardly. A motor mounting port 48 is provided in outer raceway 42 at a point approximately midway between the raceway 42 center point and outer circumference. A hydraulic motor 38 is mounted within motor mounting port 48 so that its motor drive shaft extends downwardly and into a motor gear box 62 having an exposed gearbox output gear (not shown). The make of the preferred hydraulic motor 38 is Char-lynn and the model is 2000 series 2000, 104-1216. The make of the preferred gear box 62 is Auburn and the model is 85B134020.

Lower frame structure 30 preferably includes a grid of intersecting and integral structural members 32 fastened within a rectangular outer shell 34. See FIG. 5. Mounted to the upper face of the shell 34 and fastened to structural members 32 is the turntable inner raceway 44, oriented so that the ball bearing track (not shown) opens upwardly. The gearbox output gear engages the continuous gear teeth 46 along the inner raceway 44 interior circumference, so that when the upper frame structure 50 is placed on top of the lower frame structure 30, the weight of the upper frame structure 50 and the trailer 20 on top of it are borne entirely by the turntable bearing assembly 40, and so that operation of the motor 38 rotates the upper frame structure 50 and trailer 20 relative to the lower frame structure 30 and the ground. See FIGS. 1, 3 and 6.

The four hydraulic cylinders 52 are preferably ported-rod type cylinders, meaning that their piston rods (not shown) contain axial passageways (not shown) through which hydraulic fluid is pumped during cylinder 52 operation. The piston rods remain stationary relative to the trailer 20 and the cylinders 52 move upwardly and downwardly relative to trailer 20 during operation, lowering and lifting, respectively, trailer 20.

Operation of the hydraulic motor 38 rotates the turntable outer raceway 42 and thereby rotates upper frame structure 50 relative to lower frame structure 30, rotating the trailer 20 relative to the ground. In this way, operation of the hydraulic motor 38 orients the trailer 20 and thus the intake and discharge pipe segments, as needed to perform a given pumping task. The trailer 20, for example, may be brought parallel to a levy along a field to be irrigated, the trailer 20 disconnected, and the trailer 20 rotated substantially ninety degrees so that the intake pipe segment is positioned to enter a canal along the periphery of the field and the discharge pipe segment is positioned to discharge water over the levy and into the field.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A placement and orienting apparatus for a pump and water passing pipe assembly, comprising:

a wheeled trailer supporting said pump and water passing pipe assembly;

an upper frame structure;

a lower frame structure;

a turntable bearing assembly positioned between and interconnecting said upper and lower frame assemblies and permitting rotation of said upper frame structure relative to said lower frame structure;

motor means drivably connected to one of said upper frame structure, said lower frame structure and said turntable bearing assembly to rotate said upper frame structure and said trailer relative to said lower frame structure and the ground;

and at least one upright hydraulic cylinder having a cylinder lower end connected to said upper frame structure and having a cylinder upper end connected to said trailer to drive said upper and lower frame assemblies downwardly together from said trailer such that said lower frame structure makes contact with the ground and elevates said trailer from the ground.

2. An apparatus according to claim 1, wherein said turntable bearing assembly comprises:

an outer raceway;

and a ring-shaped inner raceway mounted underneath said outer raceway and comprising a channel containing a plurality of ball bearings and having an interior circumference lined with gear teeth;

wherein said motor means comprises a gear box having an output gear in drivable contact with said inner raceway interior circumference.

3. An apparatus according to claim 2, wherein said upper frame structure comprises:

two structural cross-members intersecting and joined at their midpoints, wherein said turntable outer raceway is fastened to the underside of said upper frame structure;

and a motor mounting port in said outer raceway containing said hydraulic motor.

4. An apparatus according to claim 2, wherein said lower frame structure comprises:

a plurality of interconnected structural members, wherein said turntable inner raceway is mounted to the upper surfaces of said lower frame structure and is oriented such that said channel opens upwardly;

such that said upper frame structure is placed on top of said lower frame structure and the weight of said upper frame structure and of said trailer, pump and pipe are borne by said turntable bearing assembly.

5. An apparatus according to claim 1, wherein said at least one hydraulic cylinder is a ported-piston rod cylinder, such that the piston rod remains stationary relative to said trailer while said the cylinder moves upwardly and downwardly relative to said trailer during lowering and lifting of said trailer.

* * * * *